United States Patent [19]

Doner

[11] 4,101,750

[45] Jul. 18, 1978

[54] DOOR INTERLOCK SYSTEM FOR MICROWAVE OVEN

[75] Inventor: John T. Doner, Marion, Ohio

[73] Assignee: Whirlpool Corporation, Benton Harbor, Mich.

[21] Appl. No.: 801,832

[22] Filed: May 31, 1977

[51] Int. Cl.[2] ..... H05B 9/06

[52] U.S. Cl. ..... 219/10.55 C; 126/197; 200/61.76; 219/10.55 D

[58] Field of Search ..... 219/10.55 C, 10.55 D, 219/10.55 B; 200/61.62, 62.71, 61.76, 50 R, 50 A, 50 C; 126/197

[56] References Cited

U.S. PATENT DOCUMENTS

| | | | |
|---|---|---|---|
| Re. 28,822 | 5/1976 | Fritts | 219/10.55 C X |
| 3,659,068 | 4/1972 | Duffner et al. | 219/10.55 C |
| 3,699,299 | 10/1972 | Umezu et al. | 219/10.55 C |
| 3,715,552 | 2/1973 | Umezu et al. | 219/10.55 C |
| 3,715,554 | 2/1973 | Umezu et al. | 219/10.55 C |
| 3,728,512 | 4/1973 | Shirakami | 219/10.55 C |
| 3,748,423 | 7/1973 | Haagensen | 219/10.55 D |
| 3,766,437 | 10/1973 | Fritts | 219/10.55 C |
| 3,777,098 | 12/1973 | Tapper | 219/10.55 C |
| 3,816,688 | 6/1977 | Fritts | 219/10.55 C |
| 3,823,294 | 7/1974 | Takayama et al. | 219/10.55 C |
| 3,865,097 | 2/1975 | Robinson | 126/197 |
| 4,006,121 | 2/1977 | Isono | 219/10.55 C |
| 4,025,804 | 5/1977 | Rickard | 219/10.55 B |

*Primary Examiner*—Arthur T. Grimley

*Attorney, Agent, or Firm*—Wegner, Stellman, McCord, Wiles & Wood

[57] ABSTRACT

A door interlock system for use with a microwave oven. The interlock system includes a slider member movably mounted to the cabinet of the oven for movement between released and interlocking positions. A catch structure is provided to be movable with the slider member and an interlock structure is provided for selectively securing the door in closed position across the cabinet opening by cooperation with the catch structure. The interlock structure may include fixed latching members on the door and a movable operator on the door arranged to move the slider member between the released and interlocking positions. Actuator structure is provided to be operated concurrently with the latching of the door to operate switches associated with the microwave energy generating device to permit operation of the generating device only when the door is latched in the closed position.

29 Claims, 5 Drawing Figures

DOOR INTERLOCK SYSTEM FOR MICROWAVE OVEN

BACKGROUND OF THE INVENTION

1. Field of the Invention

This invention relates to door interlocks, and in particular to door interlocks for use in microwave ovens for effecting concurrently latching of the door in a closed position and potentiation of the control for the microwave energy generating means to permit energization thereof only when the door is in the closed and latched condition.

2. Description of the Prior Art

In the conventional microwave oven, a microwave energy generating device is provided for delivering microwave energy into a cavity defined by a cabinet having a front opening selectively closed by a door. To prevent leakage of the microwave energy from the cavity during operation of the oven, it is important to positively prevent access to the oven cavity when the microwave energy generating means is energized so as to prevent injury to the user. Thus, it is conventional to provide interlocking means for assuring that the cabinet door is in the closed and latched position before the microwave energy generating means may be energized. A number of different interlocking systems have been developed to provide such functioning. The present invention is concerned with an improved form of such a system.

One form of such interlocking system in an electronic oven is shown in U.S. Letters Pat. No. 3,339,054 of Homer W. Deaton, wherein the control includes timer operated switches, a holding circuit including a momentary switch, a safety interlock switch, a safety switch, a door switch, and a thermostat switch.

Shiro Umezu et al disclose in U.S. Letters Pat. No. 3,699,299 a locking member for locking the door in the closed position. A switch is disposed in the cabinet for controlling operation of the microwave energy generator, and means interlocked with the handle are provided for operating the switch to de-energize the generator when the locking device releases the door.

Shiro Umezu et al, in U.S. Letters Pat. No. 3,715,554, disclose the use in such a microwave oven of a locking mechanism for holding the door in the closed position including a handle connected to the locking mechanism and a switch mounted on the cabinet. The switch is interlocked with the locking mechanism for controlling operation of the generator when the door is locked and unlocked by the locking mechanism.

Shiro Umezu et al, in U.S. Letters Pat. No. 3,715,552, show a microwave oven wherein the door locking mechanism comprises an operating member mounted on the door outside the heating chamber, a switch in the cabinet, and means interlocked with the locking mechanism for operating the switch for de-energizing the generator when the operating member is operated to unlock the locking mechanism.

In U.S. Pat. No. 3,777,098 of William R. Tapper, a door latch assembly for use in a microwave oven is disclosed as having a latch element carried by the oven door and a latch receiving element mounted on the oven cabinet. The latch receiving element includes a first, fixed aperture for receiving an aligning projection of the latch element, and a movable body having a pair of apertures receiving hooked latch portions of the latch element. The movable body includes a pair of ported plates having bearing surfaces adapted to be moved by the latches. The latches extend into the plate ports after a preselected movement thereof and are secured therein by a pair of leaf springs which move the plates and body upwardly in a secured position. A safety switch is connected to each port plate and is controlled by the hooked portions of the latches.

In U.S. Pat. No. 3,816,688 of Rex E. Fritts, a safety interlock system for microwave ovens is shown having means for interrupting the power supply and/or actuating a failure indicating device. The sensing means is arranged so as to not carry the load current until a malfunction of a companion interlock occurs.

Takeshi Takayama et al, in U.S. Pat. 3,823,294, show a door interlocking system having a solenoid operated contactor with the solenoid thereof switched by at least two switching means, one of which is manually operable and the other of which is operated by operation of the lock means acting upon the door which, in turn, is operated by a drive coil connected with the power supply through one of the switching means.

In U.S. Pat. No. 3,865,097, Donald B. Robinson discloses a latch for microwave ovens provided with a plate mounted on the oven door with means on the oven cabinet for receiving the latch. A switch holder assembly and a slide bar are mounted on the cabinet with the switch holder assembly being stationary and the slide bar being actuated by an actuating bar, or button, accessible on the front face of the oven. A latch receiving element is pivotally supported between the switch holder assembly and the actuating slide bar for engagement by the latches so that when the oven door is closed and the slide bar is actuated against its normal upward biasing, the latch receiving element pivotally disengages from the latch and the door is permitted to open.

Rex E. Fritts discloses in his Re. No. 28,822, a safety interlock system for a microwave oven incorporating sensor means for detecting any malfunction. The sensing means are associated with interlocks and the sensing means, as in Fritts' U.S. Pat. No. 3,816,688, do not carry the normal load current until a malfunction of the companion interlock occurs.

SUMMARY OF THE INVENTION

The present invention comprehends an improved interlock system for use in a microwave oven for selectively securing the oven door in a closed position and selectively operating associated switch means for controlling the energization of the microwave energy generating means.

More specifically, the present invention comprehends such an interlock system including a slider member movably mounted to the cabinet for movement between released and interlocking positions, catch means movable with the slider member, and interlock means including an operator member for selectively moving the slider member to the interlocking position with the door disposed in the closed position, latch means carried by the door and engageable with the catch means with the door disposed in the closed position and as a result of the slider being disposed in the interlocking position, and actuator means operable concurrently with the latch means for operating the switch means to permit operation of the generating means only when the door is latched in the closed position.

Further more specifically, the invention comprehends the provision of such an interlock system wherein interlock means is carried by the door.

The operator may be pivotally mounted to the door and provided with a handle for selective movement between the latching and unlatching positions.

The operator may be biased to each of the two opposite positions by an overcenter spring means.

The slider means may carry a plurality of latch means which, in the illustrated embodiment, comprises pins. The latch means may define a plurality of cam surfaces engageable with the pins for drawing the door tightly against the cabinet in the closed position.

In the illustrated embodiment, the latch means includes a pair of fixed members and a movable member. The fixed members may be carried on an adjustable support carried by the door.

The switch means may include first and second switches each arranged to interrupt power to the generating means upon unlatching of the door. The circuit means may further include monitoring means for sensing the condition of the first switch and the position of the door so as to disable the circuit upon sensing a "fail" condition of the first switch when the door is removed from the closed position.

The monitoring means may include a switch and a sensing element operated by one of the fixed latch members on the door.

The cabinet is arranged to prevent straight-through access to at least one of the switches.

In the illustrated embodiment, the means for operating the second switch comprises a linkage means.

In the illustrated embodiment, the primary door interlock switch is actuated by the above indicated linkage means so as to be thrown to its open position to de-energize the microwave generating means before the slider is moved to release the door latching means. The door latching means may frictionally retain the slider until effectively positively moved by the movable latch member operated by the door handle. Thus, the movable latch member may serve to urge the slider to the latching position and to effect movement of the slider from the latching position during the door opening operation.

The microwave oven door interlock system of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
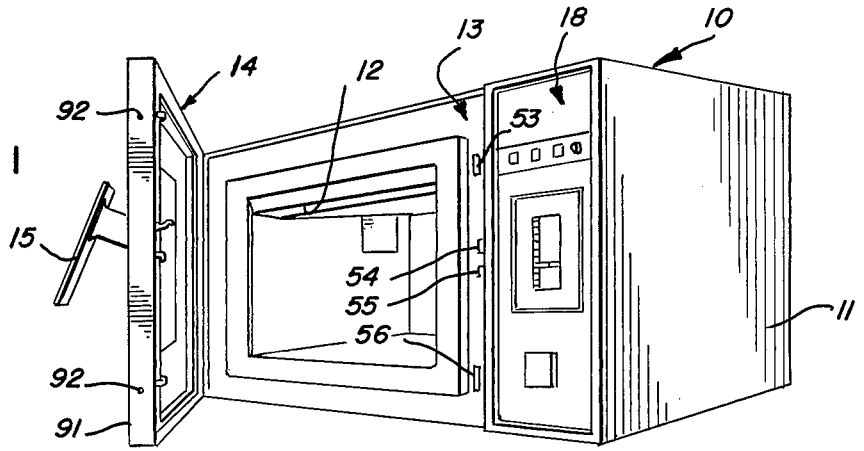
FIG. 1 is a perspective view of a microwave oven having an interlock system embodying the invention.
Figure 5:
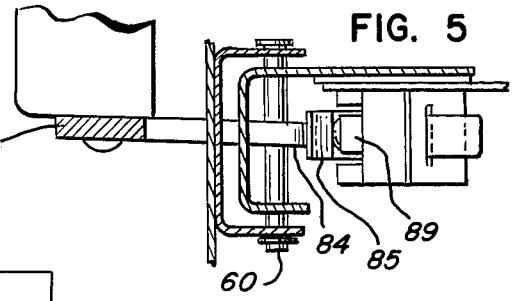
FIG. 5 is a fragmentary horizontal section taken substantially along the line 5—5 of FIG. 4.

In the exemplary embodiment of the invention as disclosed in the drawing, a microwave oven generally designated 10 is shown to comprise an outer cabinet 11 defining an oven cavity 12 opening through a front 13 of the cabinet with the front opening thereof being selectively closed by a door 14.

Figure 3:
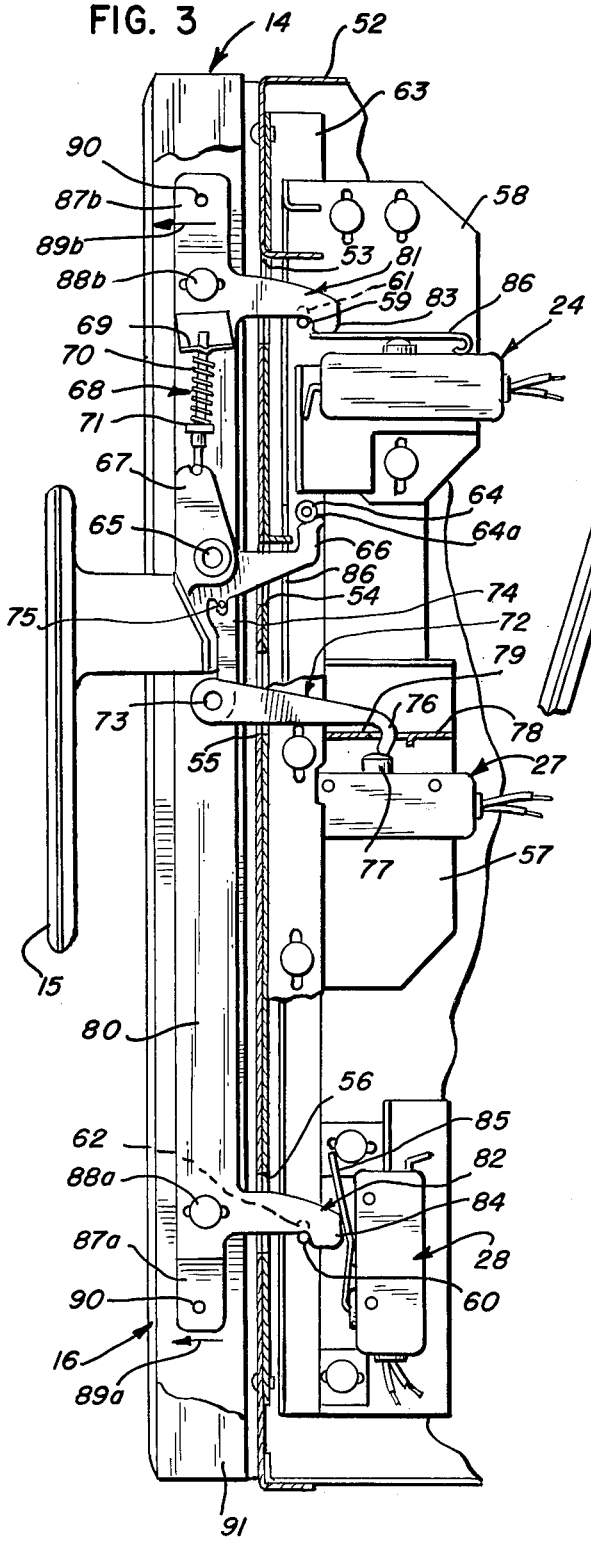
FIG. 3 is a fragmentary vertical section illustrating the improved interlock means as arranged with the door in the closed and latched disposition.
Figure 4:
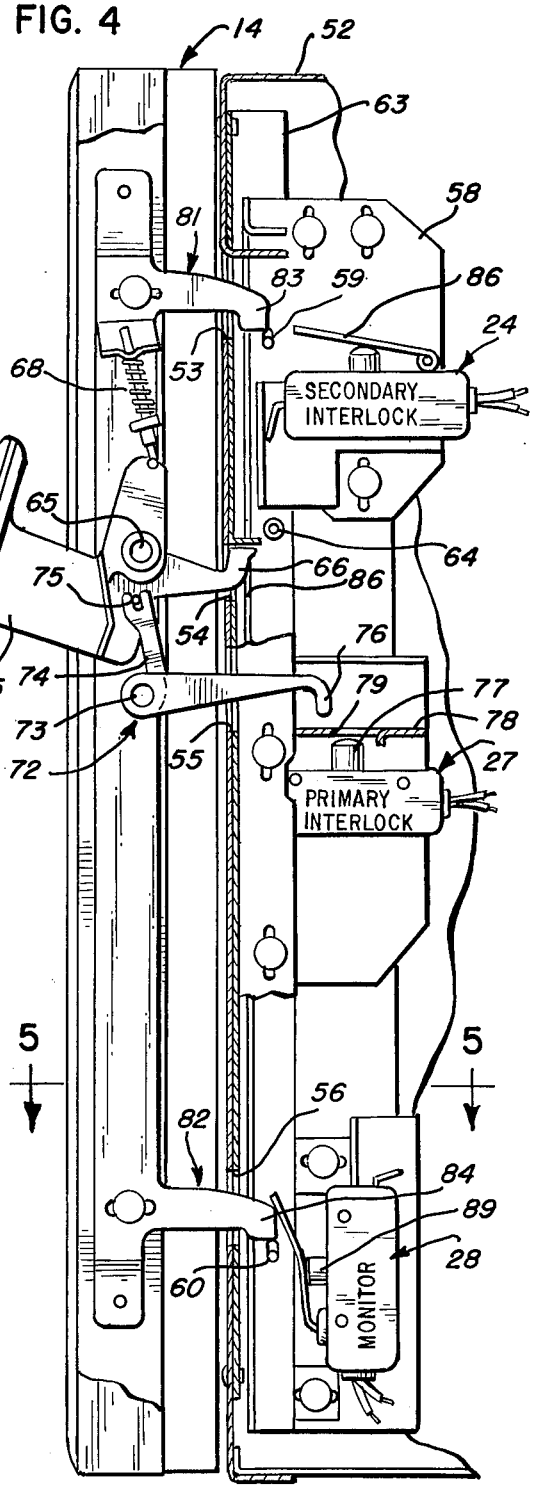
FIG. 4 is a similar vertical section but with the door as arranged in a substantially closed position and the interlock means in the unlatched disposition.

Door 14 is provided with an operator member, or handle, 15 which serves not only for manually controlling the movement of the door between an open position shown in FIG. 1 and the closed position thereof shown in FIG. 3, but also, as shown in FIGS. 3 and 4, comprises means for controlling an interlock system generally designated 16. The interlock system is arranged to provide a positive latching of the door in the closed position, as shown in FIG. 3, and to prevent energization of the microwave energy generating device, or magnetron, 17 other than when the door is so latched in closed position. As shown in FIG. 1, the cabinet is provided with a manual control means 18 for selectively controlling energization of the apparatus. Interlock system 16 permits control 18 to effect operation of the apparatus only when the door is in the closed and latched position of FIG. 3.

Figure 2:
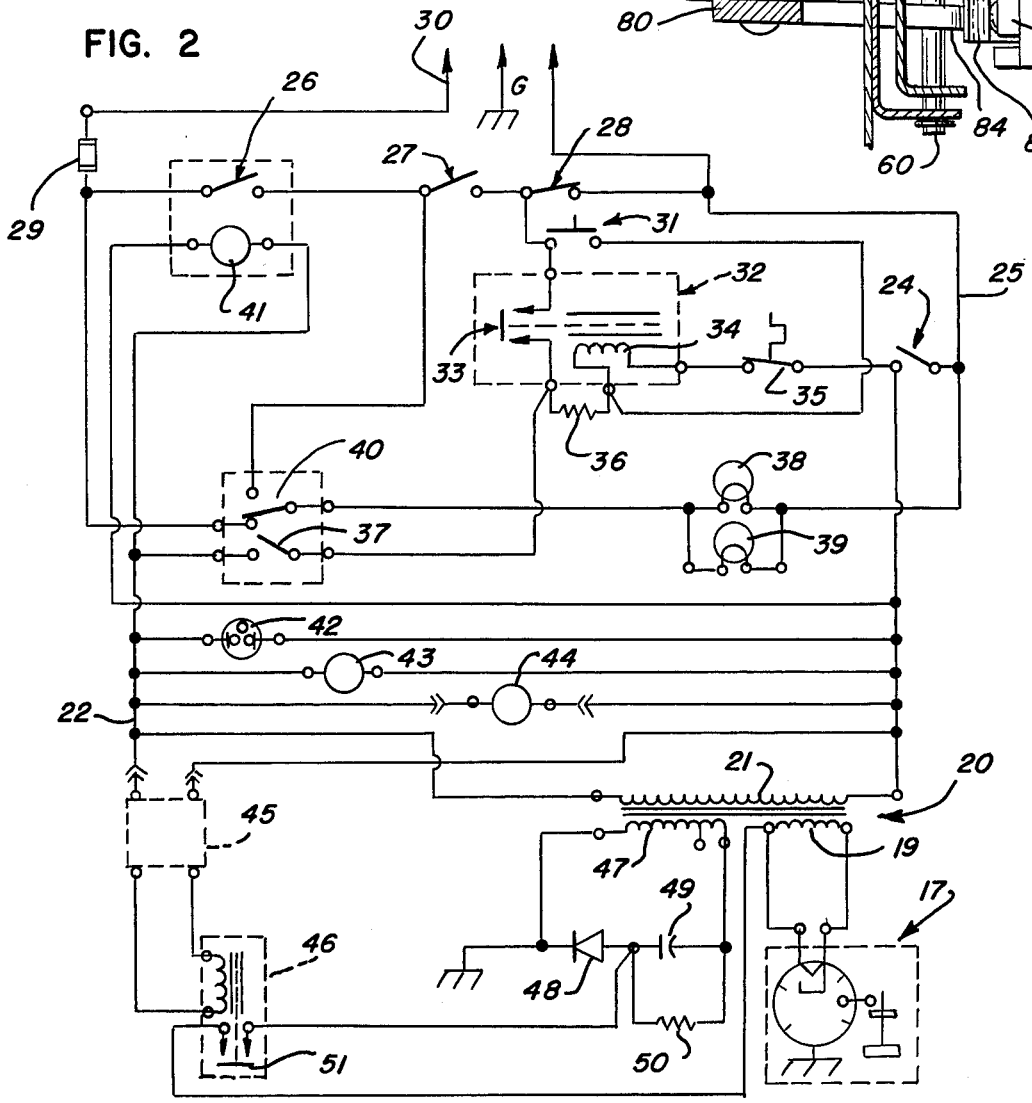
FIG. 2 is a schematic wiring diagram thereof.

As shown in FIG. 2, the magnetron 17 is energized from a power transformer generally designated 20 which includes a secondary filament winding 19. The primary winding 21 of the power transformer is connected between a first power lead 22 and a second power lead 23. The second power lead is connected through a normally open secondary door interlock switch 24 to a power supply lead 25. The control circuit further includes a timer switch 26 connected in series with a normally open primary door interlock switch 27 and a normally closed monitor switch 28 from power supply lead 25 through a suitable fuse 29 to the opposite power supply lead 30. Power supply leads 25 and 30 may comprise, with a ground lead G, a three-wire conventional power supply.

The control circuit further includes a momentary contact start switch 31 and a cook relay generally designated 32 having a switch 33 connected to lead 22 for providing power thereto upon release of the start switch 31. The coil 34 of the cook relay is connected from switch 31 through a thermal protector switch 35 to secondary door interlock switch 24. The start switch 31 is connected to the lead 22 through a resistor 36 and a door activated, normally open glass integrity switch 37.

A parallel combination of an oven light 38 and a dial light 39 is connected from power supply lead 25 through a single pole, double throw oven light switch 40 and the fuse 29 to power supply lead 30.

Timer switch 26 is controlled by a suitable timer motor 41. The control may further include a "cook" indicator 42, a fan 43, and a stirrer motor 44 connected in parallel between power leads 22 and 23. Still further, the control may include a solid state power selector 45 and a read relay 46.

The microwave generator may include a secondary winding 47 of transformer 20 having connected thereacross a suitable high voltage rectifier 48 and a high voltage capacitor 49. The capacitor may have connected in parallel therewith a high holding value resistor 50 and the connection between rectifier 48 and capacitor 49 may be connected through the normally open switch 51 of the read relay to one side of the secondary filament winding 19 of the transformer 20.

As indicated briefly above, the invention is concerned with means for preventing energization of the microwave energy generator 17 other than when the door 14 is latched closed. Referring now more specifically to FIGS. 3 and 4, the oven front defines a frame 52 which, as shown further in FIG. 1, includes openings 53, 54, 55 and 56. The primary door interlock switch 27 is mounted to a bracket 57 carried on the frame rearwardly of and slightly below the opening 55. The secondary door interlock switch 24 and the monitor switch 28 are mounted to a slider member 58 which is vertically movable between an upper latching position, as shown in FIG. 3, and a lower release position, as shown in FIG. 4. To guide the slider member, a pair of mounting pins 59 and 60 are mounted to the slider in vertically elongate slots 61 and 62 thereof. The slots extend through suitable corresponding, somewhat longer slots in vertical wall members 63 of the frame. As shown in FIGS. 3 and 4, the pins 59 and 60 are disposed rearwardly of the openings 53 and 56, respectively. As will be brought out more fully hereinafter, pins 59 and 60 further define catch means for use in securing the door 14 in the closed position of FIG. 3. Also mounted to the slider is a fixed pin 64 disposed rearwardly and slightly above the opening 54.

Handle 15 is mounted to the door 14 by a pivot 65 and includes an inner arm 66 which projects through opening 54 of the cabinet frame to engage a roller 64a mounted on the pin 64 when the handle is brought to the latching position of FIG. 3, with the door in closed position across the cavity opening 12.

Also connected to the handle 15 is a second arm 67. Arm 67 is connected by a toggle 68 to a bracket 69 on the door. Toggle 68 includes a compression spring 70 extending between an adjusting nut 71 on the toggle and the bracket 69 to provide a selective biasing of the arm 67 in an overcenter manner to either of the latched position of the handle as seen in FIG. 3, or the unlatched position of the handle as seen in FIG. 4.

A third arm 72 is pivotally mounted to the door by a pivot 73 and is connected by means of a yoke 74 to a pin 75 on the handle 15. Thus, as the handle is swung about pivot 65, arm 72 correspondingly is swung about the pivot 73 so as to bring a distal finger 76 of the arm 72 toward and from an actuator button 77 of the primary door switch 27. As shown in FIGS. 3 and 4, the bracket 57 includes a horizontal wall 78 provided with an opening 79 through which the finger 76 may move to and from the actuator 77, the opening 79 being disaligned relative to the opening 55 so as to prevent engagement of the actuator 77 by a straight instrument inserted through the opening 55 thereby effectively preventing bypassing of the safety feature provided by the switch 27.

In the illustrated embodiment, the pivots 65 and 73 are mounted to a support member, or bar, 80 having formed integrally therewith latch means including an upper fixed latch 81 and a lower fixed latch 82. Upper latch 81 includes a downturned finger 83 for engaging the pin 59 to latch the door 14 in the closed position, as shown in FIG. 3, when the pin 59 is brought upwardly behind the finger 83. Lower latch 82 is provided with a similar turned finger 84 which engages the pin 60 in this arrangement of the door. Thus, the door is securely latched at both the top and bottom thereof in the closed and latched position.

As indicated above, the slider carrying the pins 59 and 60 is moved upwardly as an automatic concomitant of the moving of the operator member, or handle, 15 to the latching position when the door is disposed in the closed position of FIG. 3. Thus, at this time, the arm 66 engages the roller 64*a* of pin 64 and urges the pin upwardly from the position of FIG. 4 to the latching position of FIG. 3. Because of the interconnecting linkage arrangement of arm 72 and arm 66, switch 27 does not close until the slider is moved upwardly sufficiently to engage the pins 59 and 60 with the fixed latches as discussed above. Thus, the control circuit is maintained open by the open condition of switch 27 and operation of the control 18 by the user is ineffective, as shown in FIG. 2, until the interlock system is arranged as shown in FIG. 3.

As further shown in FIG. 2, the monitor switch 28 is normally closed. However, as the door is closed, lower latch 82 contacts an actuator 85 of switch 28 so that the switch 28 is opened. As shown in FIG. 3, as lower latch 82 moves into latching engagement with pin 60 to latch the door in the closed position, the lower latch 82 continues to hold switch 28 in the open condition. The opening of switch 28 is thus caused to occur before the closing of primary interlock switch 27 to avoid short circuiting of the power supply as the door is closed since the door must be closed before being effectively latched in the closed position.

As further shown in FIG. 3, the upward movement of the slider member also causes the actuator 86 of switch 24 to be engaged by finger 83 of latch 81, thereby closing switch 24 as an incident of the latching of the door in the closed position.

Thus, in the closed, latched position of door 14, the primary door interlock switch 27 and the secondary door interlock switch 24 are closed thereby permitting operation of the microwave oven by the user once a suitable setting of the manual control 18 has been accomplished. The use of the door latching members 81 and 82 to control the switches 24 and 28, respectively, provides an automatic interlocking between the latching and permissible energization of the microwave generator.

When door handle 15 is moved from the latching position of FIG. 3 to the release position of FIG. 4, arm 72 releases actuator 77 of switch 27 concurrently with the downward movement of the arm 66. However, the slider member 58 may move downwardly without concurrent downward movement of the pins 59 and 60 as such movement is accommodated by the vertically elongated slots 61 and 62, thereby maintaining the pins 59 and 60 in latched association with the fixed latches 81 and 82. The retention of the pins in such engagement is frictional and, thus, when the arm 66 is swung downwardly, or in a clockwise direction as seen in FIG. 3, it is caused to engage the lower edge of an opening in the slider member through which the arm 66 extends so as to forcibly urge the slider member downwardly and effect the removal of pins 59 and 60 from the fingers 83 and 84, respectively.

The switch actuators and switches are thus arranged so that switches 27 and 24 open during the unlatching process but switch 28 closes only after the pins 59 and 60 are removed from the latches 83 and 84 and the door is moved partially away from the closed position of FIG. 3. Thus, when the door is unlatched and opened, switch 27 opens before switch 28 closes to prevent the short circuiting through fuse 29 discussed above, at this time. Further, the arrangement of the switches effectively positively prevents continued energization of the microwave generating means after the release of the latches, thereby providing further improved safety in the operation of the microwave open.

By disposing the fixed latches at the top and bottom of the door 14, a positive securing of the door uniformly around the cavity opened is obtained.

By separating the door closing and latching functions by the improved interlocking system of the present invention, no slamming of the door is required so as to effect a concurrent latching operation. A conscious effort must be expended on the part of the operator to effect the desired latching operation. Reversely, the separation of these functions effectively eliminates sticking of the door when opening while yet permitting a tight seal of the door to the cabinet in the closed position.

The spring toggle 68 further may serve to facilitate movement of the slider to the lowermost position of FIG. 4 as in the overcenter position, the arm 66 is urged downwardly and, thus, is urged against the edge 86 of the slider member opening to effect the desired downward displacement of the slider member from the interlocking position of FIG. 3 to the release position of FIG. 4.

To facilitate adjustment in the positioning of latches 81 and 82 on the door relative to the switches 24 and 28, the support bar 80 includes offset end portions 87*a* and 87*b* adjustably secured to the door by means of a pair of screws 88*a* and 88*b*. Adjustment of the latches is accomplished by firstly closing and latching the door and then applying a preselected outwardly directly force in turn to the side shoulders of the offset portions 87*a* and 87b while tightening the associated screws 88*a* and 88*b*, respectively. For example, after the door is closed and latched, a preselected force is applied to offset portion 87*a* in the direction indicated by arrow 89*a* in FIG. 3 so that finger 84 is drawn tightly against pin 60. Before the preselected force is removed, screw 88*a* is tightened. In similar fashion, a preselected force is then applied to offset portion 87*b* in the direction of arrow 89*b* and screw 88*b* tightened to secure the bar in the adjusted disposition.

A threaded hole 90 may be provided in each offset end portion of support bar 80 to permit removable attachment to the door of a door end cap or cover 91 by means of screws 92. The cover 91 serves to generally enclose the latch mechanism carried by the door for both safety and appearance purposes while permitting facilitated access to the mechanism when desired.

The foregoing disclosure of specific embodiments is illustrative of the broad inventive concepts comprehended by the invention.

The embodiment of the invention in which an exclusive property or privilege is claimed is defined as follows:

1. In a microwave oven having a cabinet defining an oven cavity having a front opening, a door movably mounted to said cabinet for selectively closing said opening, electrically operable microwave energy generating means for supplying electromagnetic energy to said cavity, and an electrical circuit including switch means for providing electric power from an external source to said electrically operable means, improved means for selectively securing said door in a closed position wherein the door closes said opening, and selectively operating said switch means, said improved means comprising:

a slider member movably mounted to said cabinet for movement between released and interlocking positions; catch means movable with said slider member; and interlock means including an operator member for selectively moving said slider member to said interlocking position with said door disposed in said closed position, latch means carried by said door and engageable with said catch means with said door disposed in said closed position and as a result of said slider member being disposed in said interlocking position, and actuator means operable substantially concurrently with said latch means for operating said switch means to permit operation of said generating means only when said door is latched in said closed position.

2. The microwave oven of claim 1 wherein said interlock means is carried by said door.

3. The microwave oven of claim 1 wherein said operator member is pivotally mounted on an end portion of said door and is provided with a handle for effecting selective movement thereof between latching and nonlatching positions.

4. The microwave oven of claim 3 including overcenter spring means for biasing said operator member selectively to each of said latching and nonlatching positions.

5. The microwave oven of claim 1 wherein said slider means carries a plurality of pins and said latch means define a plurality of members each having a cam surface engageable with a different corresponding one of said pins for drawing said door tightly against said cabinet as a result of said slider member moving to said interlocking position thereby to secure said door in said closed position.

6. The microwave oven of claim 3 wherein a cover is secured to said door, said cover substantially enclosing said operator member and defining an opening through which said handle extends.

7. The microwave oven of claim 1 wherein said latch means comprise a pair of fixed members mounted to vertically spaced top and bottom portions respectively of said door.

8. The microwave oven of claim 1 wherein said operator member includes means for selectively engaging said slider member to move said slider member selectively to and from said interlocking position.

9. The microwave oven of claim 1 wherein said operator member defines surfaces engageable with said cabinet for securing said door in said closed position.

10. The microwave oven of claim 7 wherein each of said fixed members are carried by a support having offset portions at its opposite ends and means for adjustably securing said offset portions to said door for adjusting the alignment of said fixed members relative to said slider member.

11. The microwave oven of claim 1 wherein said switch means includes first and second switches in said circuit each arranged to interrupt power to said generating means upon unlatching of said door.

12. The microwave oven of claim 11 wherein said circuit means further includes monitoring means for monitoring the condition of said first switch and the position of said door, said monitoring means being operable to disable said circuit upon the instance of a failed condition of said first switch when said door is removed from said closed position.

13. The microwave oven of claim 12 wherein said monitoring means includes a monitor switch and an actuator for controlling said switch, said actuator being operated by one of said fixed latch members independently of the position of said slider member in response to the opening and closing of said door.

14. The microwave oven of claim 11 wherein said latch means comprise a pair of members adjustable fixed to said door, said first switch being mounted on said slider member and operated by one of said fixed latch means members.

15. The microwave oven of claim 11 wherein said operator member includes means for operating said second switch in response to movement of said operator member with said door in said closed position.

16. The microwave oven of claim 11 wherein said cabinet includes means for preventing straightthrough access to at least one of said switches.

17. The microwave oven of claim 15 wherein said means for operating said second switch comprises linkage means responsive to the position of said operator member.

18. In a microwave oven having a cabinet defining an oven cavity having a front opening, a door movably mounted to said cabinet for selectively closing said opening, electrically operable microwave energy generating means for supplying electromagnetic energy to said cavity, and an electrical circuit including switch means for providing electric power from an external source to said electrically operable means, improved means for selectively securing said door in a closed position wherein the door closes said opening, and selectively operating said switch means, said improved means comprising:

a slider mounted in said cabinet and movable between released and interlocking positions.

a plurality of latch members fixed to said door and engageable with said slider for securing said door in said closed position;

a latching mechanism mounted on said door and selectively movable to first and second positions with respect to said door, said latching mechanism engageable with said slider with said door in said closed position to hold said slider in said actuated position when said latching mechanism is in said second position;

a secondary door switch mounted on said slider and operated by a first of said latch members in response to the position of said slider, said secondary door switch connected in series with said power source and said generating means and operable to disable said generating means when said slider is in said nonactuated position;

a primary door switch fixed to said cabinet and operated by said latching mechanism, said primary door switch connected in series with said external power source and said generating means and operable to disable said generating means whenever selectively (a) said door is in an open position and (b) said latching mechanism is in said first position; and monitoring means for sensing a failure of said primary door switch, said monitoring means including a monitor switch mounted in said cabinet and operated by a second of said latch members in response to the movement of said door relative to said closed position.

19. The microwave oven of claim 18 wherein spring means are provided for biasing said latching mechanism towards said first and second positions, said spring means including a spring attached to said latching mechanism and said door in an overcenter configuration.

20. The microwave oven of claim 18 wherein said slider includes a plurality of pins fixed thereto, said fixed latching members each defining a cam surface engageable with a different corresponding one of said pins for drawing said door tightly against said cabinet as said slider moves to said actuated position thereby securing said door in said closed position.

21. The microwave oven of claim 18 wherein said fixed members are two in number and spaced apart on said door for securing top and bottom portions respectively of said door to said cabinet.

22. The microwave oven of claim 18 wherein said latching mechanism defines a first surface for carrying said slider into said actuated position and a second surface for forcing said slider into said nonactuated position.

23. The microwave oven of claim 18 wherein said plurality of fixed latch members are carried by a support member which includes an offset portion at spaced ends thereof, each said offset portion providing a shoulder means for facilitating manual adjustment of the position of said support member and latch members thereon relative to said slider member with said door secured in said closed position.

24. In a microwave oven having a cabinet defining an oven cavity having a front opening, a door movably mounted to said cabinet for selectively closing said opening, electrically operable microwave energy generating means for supplying electromagnetic energy to said cavity, and an electrical circuit including first and second switch means for providing electric power from an external source to said electrically operable means, improved means for selectively securing said door in a closed position wherein the door closes said opening, and selectively operating said switch means, said improved means comprising:

means for mounting said first switch to said cabinet;

a mounting member movably carried by the cabinet and carrying said second switch;

a handle movably carried by the door;

first means movable with said handle to move said mounting member to a latching position;

second means movable with said handle to actuate said first switch when said door is in said closed position;

a catch element movably carried by said mounting member;

a latch on said door engaged by said catch element to latch said door in the closed position when the mounting member is moved by said first means to said latching position; and means for sequentially causing said second means to discontinue actuation of said first switch, and then cause movement of said mounting member from said latching position, said latch further defining means for actuating said second switch only when said movable member is in said latching position.

25. The microwave oven means of claim 24 further including a third switch carried by said movable member, and said door is provided with means for de-actuating said third switch as an incident of said door being disposed in the closed position.

26. The microwave oven means of claim 24 wherein a second catch element is movably carried by said movable member, and a second latch is carried by the door to be engaged by said second catch element to latch said door in the closed position when the mounting member is moved by said first means to said latching position.

27. The microwave oven means for claim 26 further including a third switch carried by said movable member and fuse means associated with said third switch means, said second latch further defining means for de-actuating said third switch when said door is in said closed position, said third switch and said fuse means being connected in said circuit so that said fuse means disables said generating means whenever said door is removed from said closed position while said second switch remains in said actuated position.

28. The microwave oven means of claim 24 wherein said catch element is slidably carried by said mounting member.

29. The microwave oven means of claim 24 wherein said cabinet defines a frame portion having a slot, and said catch element includes a portion slidably received in said slot.

* * * * *